US005595388A

United States Patent [19]

Swigart

[11] Patent Number: 5,595,388

[45] Date of Patent: Jan. 21, 1997

[54] DARK COURT GAME APPARATUS AND METHOD

[76] Inventor: David Z. Swigart, 440 Glenhaven Dr., Lincoln, Nebr. 68505

[21] Appl. No.: 607,327

[22] Filed: Feb. 26, 1996

[51] Int. Cl.[6] ..... A63B 71/04

[52] U.S. Cl. ..... 473/465; 473/415; 473/570

[58] Field of Search ..... 273/411, 30, DIG. 26

[56] References Cited

U.S. PATENT DOCUMENTS

| | | | |
|---|---|---|---|
| 2,020,484 | 11/1935 | Turner | 240/6.4 |
| 3,301,558 | 1/1967 | Clapham | 273/51 |
| 3,649,029 | 3/1972 | Worrell | 273/186 C |
| 3,804,411 | 4/1974 | Hendry | 273/58 G |
| 3,872,623 | 3/1975 | Spaulding, Jr. | 273/411 X |
| 3,917,264 | 11/1975 | Davidson | 273/DIG. 24 X |
| 3,971,560 | 7/1976 | Panosh | 273/30 |
| 4,528,548 | 7/1985 | Oberan | 340/323 R |
| 4,801,928 | 1/1989 | Minter | 340/691 |
| 5,140,301 | 9/1992 | Watanabe | 340/332 |
| 5,174,571 | 12/1992 | Aubusson et al. | 273/31 |
| 5,301,955 | 4/1994 | Fedullo | 273/411 |
| 5,337,225 | 9/1994 | Brookman | 362/145 |
| 5,417,438 | 5/1995 | Poff | 273/411 |

*Primary Examiner*—William H. Grieb

*Attorney, Agent, or Firm*—Law Office of John A. Behner

[57] ABSTRACT

A dark court game apparatus and method involves securing illumination markers to a ball-based game court to identify portions of the court so the players can orient themselves relative to the court when it is rendered dark. At least a portion of a game ball is likewise illuminated so that its location and direction can be detected in the dark. Various combinations of illumination markers may be illuminated for varying the difficulty of game play with the least number of illumination markers corresponding to the highest level of difficulty. The invention is further directed to the court, illumination markers and game ball used to accomplish the method of the invention.

23 Claims, 3 Drawing Sheets

DARK COURT GAME APPARATUS AND METHOD

BACKGROUND OF THE INVENTION

1. Technical Field

The present invention was referenced in Document Disclosure No. 363,619 filed in the Patent and Trademark Office Oct. 18, 1994.

The present invention relates generally to an improved ball based court game and more particularly to an apparatus and method for playing a ball based court game in the dark.

Athletes seeking recreation and competition in sports and businesses providing facilities for athletic events are on a never ending quest to provide new challenges to increase interest and participation in those activities. Such quests may lead to entirely new games or modifications to existing games. The present invention falls into this latter category.

Ball based court games include such games as racket ball, hand ball, and squash, among others. Whereas the proportion, size, layout and style of racket if any, that are used for each sport varied between the different games, the common element which has not heretofore been varied is that all games are played in the light.

The present invention introduces a new dimension to ball based court games by providing an apparatus and method by which such games may be played in the dark. "Dark" is defined in Webster's Dictionary as "devoid or partially devoid of light: not receiving, reflecting, transmitting, or radiating light". Whereas, total absence of external light is the ideal, any given court may have minimal light enter around the door or elsewhere. The apparatus and method of the invention are designed to exclude both exterior and interior light, except for certain illumination markers on the court and ball to provide orientation for the players during game play.

2. Description of the Prior Art

Whereas certain illumination means have been previously suggested for use in association with ball based court games, none have provided conditions conducive to play in the dark. For example, Fedullo, U.S. Pat. No. 5,301,955 illustrates lighted paddles and an internally lite game ball for play during nighttime conditions. The illuminations of these portable articles would afford no orientation to players in a truly dark Court. Turner, U.S. Pat. No. 2,020,484, discloses a ball having internal lighting. Aubusson et al. U.S. Pat. No. 5,174,571 discloses a lighted game court but one having fluorescent floor markings for different sports and laser illumination means for illuminating selected fluorescent markings associated with a particular sport. Finally, Oberan, U.S. Pat. No. 4,528,458, discloses an electronic scoring apparatus for determining the validity of "kill shots" in a lighted court.

Lighting strips have been proposed for non-athletic purposes and environments, such as for egress. One example is Brookman, U.S. Pat. No. 5,337,225, which discloses illumination lighting strips for use on the walls, ceilings, floors and walkways. The source of illumination for the lighting strips may be light-emitting diodes or incandescent lamps.

Whereas the above prior art relates generally to lighting systems and some to lighting devices associated with court games, none disclose an apparatus and method which enable a ball based court game player to orient himself relative to the court for true play of the game in the dark.

A primary object of the invention therefore is to provide an apparatus and method that enable participants to play ball-based court games in the dark.

Another object of the invention is to increase the level of challenge and difficulty of a ball-based court game over that of conventional lighted court games.

Another object of the invention is to provide an apparatus and method for varying the difficulty of play of a ball-based court game by illuminating more or less illumination markers on the court.

Another object of the invention is to provide a dark court game apparatus and method utilizing illumination markers which minimize interference with normal ricocheting or rebounding of a game ball on the various court surfaces.

Another object is to provide a dark court game apparatus and method utilizing illumination markers which are visible in the dark but which minimize the radiation of light into a dark court.

Another object is to provide a dark court game apparatus and method with illumination markers on the court and ball for orientation relative to the dark court and on the opposing players to assess their positions and prevent collisions.

Another object of the invention is to provide a dark court game apparatus and method which, when the court is lighted, minimize any interference with conventional ball based court games in the light.

SUMMARY OF THE INVENTION

The method of the invention for preparing a game court for play in the dark includes the steps of securing illumination markers to the court to identify locations thereon in the dark, substantially excluding external light from the court thereby to render the court dark, illuminating at least some of the illumination markers and illuminating at least a portion of the surface of a game ball so that it will be visible during play in the dark.

The method may further include such steps as providing elongated electrically actuated illumination strips as the illumination markers and enclosing those strips within a protective channel and covering the channel with a light filter to reduce radiation of light into the court from the strips. A colored translucent sheet material may be used as the light filter. The illumination markers are preferably arranged adjacent the edges of the floor, ceiling and walls, with additional markers arranged to define a service area and foul line on the floor. It may be helpful for the method to additionally include the step of illuminating the game players, such as with light emitting markers, to identify their position and prevent collisions during play in the dark.

Likewise, the invention is directed to the apparatus described above for playing a ball based court game in the dark. That apparatus may include a series of electrical circuits, each with selected illumination markers electrically connected to it and switch means for electrically actuating the illumination markers of that respective electrical circuit whereby varying combinations of circuits are actuateable to vary difficulty of game play on the court in the dark. The switch means may preferably be a single multi-position switch moveable between several positions for actuating various combinations of electrical circuits according to the difficulty level desired for the game. The means for illuminating at least a portion of the surface of the game ball may be a phosphorescent material and preferably covers less than the entire surface of the game ball so that the direction of rotation of the game ball may be detected in the dark.

The dark court game apparatus and method of the invention afford a welcome diversion and challenge for ball based court game players for the purpose of increasing the interest and participation of players in all types of ball based court games. A facility equipped with handball, racquetball, or squash courts can provide its patrons with a novel facility for an exciting new game with very little investment or alterations of their existing court facilities.

DESCRIPTION OF THE PREFERRED EMBODIMENT

Figure 1:
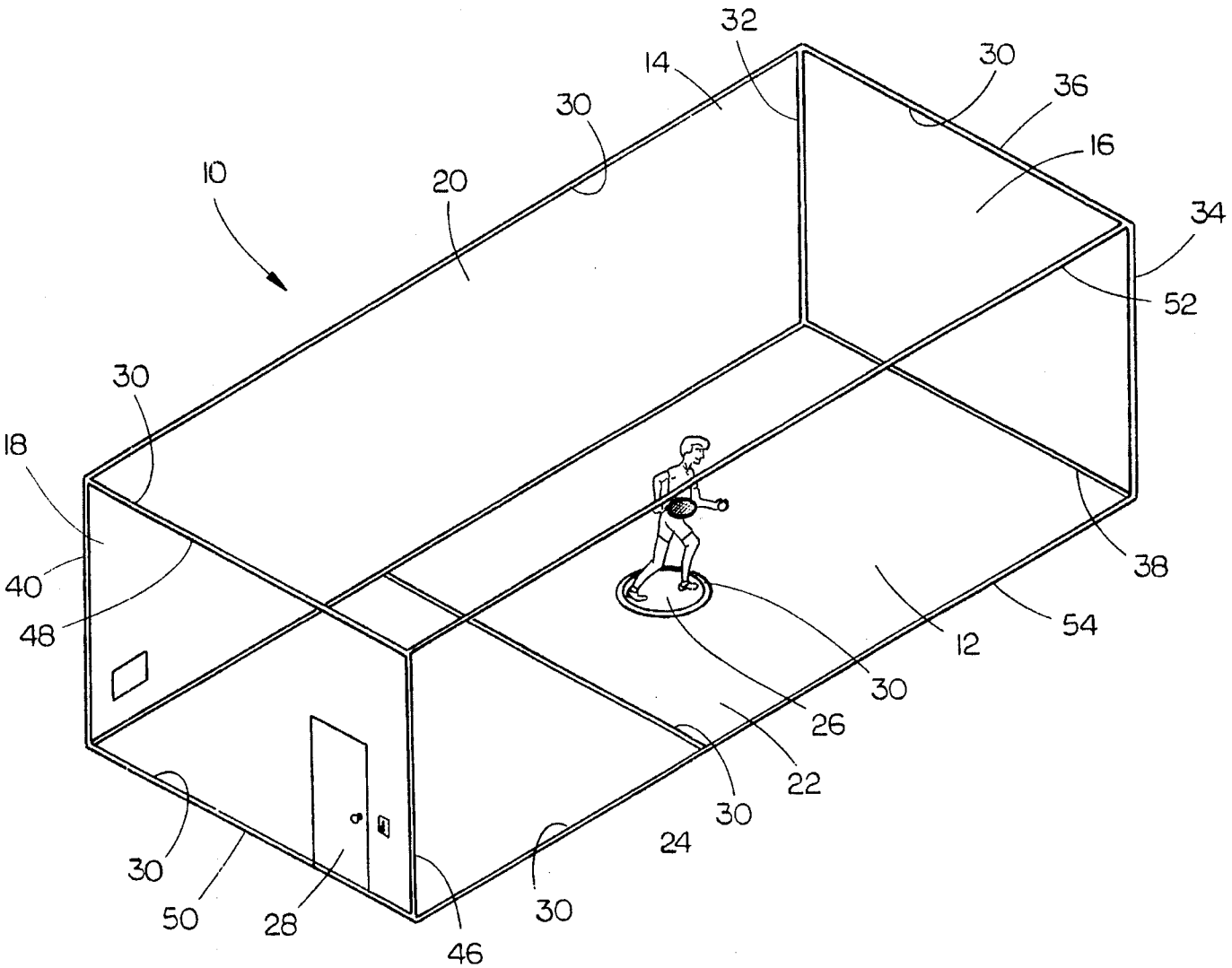
FIG. 1 is a perspective view of a game court equipped with the apparatus of the invention and indicating a player in the service area thereof.

The facility or apparatus for playing a ball-based court game in the dark, according to the present invention, is illustrated in FIG. 1 as including a substantially enclosed court 10 having a floor 12, ceiling 14 and side walls including front wall 16, rear wall 18 and opposite side walls 20 and 22. Typically, floor 12 bears markings for a particular game, such as foul line 24 and some form of service area 26. An ingress/egress door 28 is provided through one wall, preferably the rear wall 18. The court as described may be any conventional hand ball court, racquetball court, squash court, or a larger or smaller court of any selected dimensions to accommodate the novel apparatus of the invention for rendering it suitable for play of a ball-based game in the dark. Whereas an elongated rectangular court is illustrated, the proportional size and shape may be varied as desired to accommodate a particular game, but the apparatus is most readily and economically installed in an existing court of the general rectangular shape illustrated. The court surfaces are preferably hard and flat and constructed of any materials suitable for existing game courts. Likewise, the position, number and shape of the foul line 24 the foul area and service area(s) 26 may correspond to those found in conventional game courts for racquetball, handball, squash or the like, or an original pattern may be selected particularly for a dark court game.

A plurality of illumination markers 30 are installed on the court surfaces for illuminating selected portions of the surfaces so that a player in the dark can orient himself relative to the court and judge the placement and accuracy of his or her shots. In FIG. 1 the illumination markers 30 are illustrated as elongated electrically actuated illumination strips positioned closely adjacent the left front corner 32, the right front corner 34, the upper and lower edges 36 and 38 of front wall 16, the rear left corner 4 the upper and lower edges 42 and 44 of side wall 20, the right rear corner 46, the upper and lower edges 48 and 50 of rear wall 18 and the upper and lower edges 52 and 54 of side wall 22. Additional illumination strips are placed along the foul line 24 and service area 26 to define and illuminate those markings to players in the dark.

Figure 2:
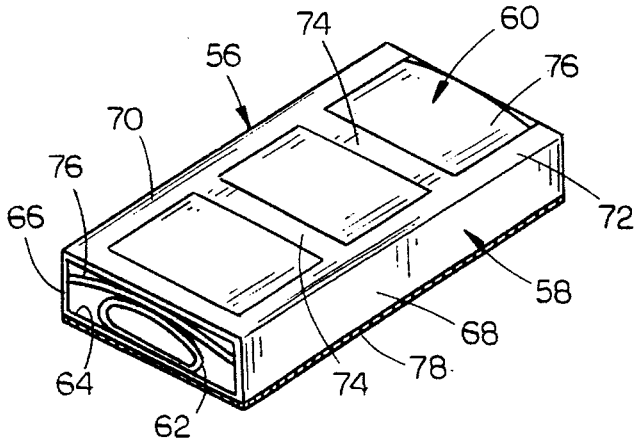
FIG. 2 is a foreshortened perspective view, partially in section, of an illumination marker of the invention.

FIG. 2 illustrates a foreshortened length of a preferred embodiment of an elongated electrically actuated illumination strip 56 for use as the illumination markers 30 of the invention. Strip 56 includes an elongated shallow channel 58 having an open side 60 and an elongated illumination means such as a neon tube 62 situated within the channel to reduce radiation of light from the neon tube into the court 10. Channel 58 may have a flat bottom wall 64, upstanding edge walls 66 and 68 which may terminate an inwardly directed flanges 70 and 72 for restricting the open side 60 and retaining a light filter means described below. The flanges may be interconnected by spaced apart cross bars 74 in the plane of the flanges for physically protecting the filter and neon tube 62 from impact by a ball. The neon tube 62 is preferably somewhat oval or flattened to minimize the required height of channel 58.

A light filter 76 in the form of a strip of translucent colored sheet material may be installed within the channel between the neon tube and cross bars 74 to render the channels 58 clearly visible while minimizing radiation of light from them.

A preferred means for installing the electrically actuated illumination strips 56 is to provide an adhesive layer 79 on the underside of bottom wall 64 for securely adhering the channel 58 to a selected court surface.

Figure 3:
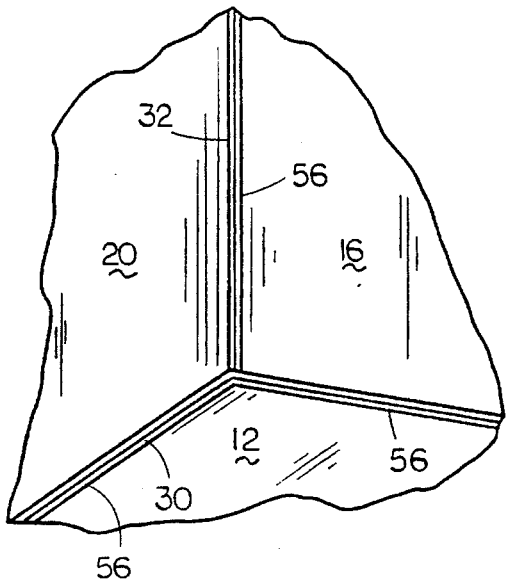
FIG. 3 is a partial perspective view of one corner of a court equipped with the illumination markers of the invention.

Existing courts to be retrofitted for dark court games will likely have the electrically actuated illumination strips 56 adhesively secured to the court surfaces closely adjacent on the edges thereof. Referring to FIG. 3, front wall 16 has an illumination strip 56 at a position parallel to and closely adjacent the front left corner 40. Likewise floor 12 has illumination strips 56 installed parallel to and closely adjacent the lower edge 44 of side wall 20 and the lower edge 38 of front wall 16. Other illumination strips 56 are similarly placed along all or selected ones of the aforementioned edges and corners of the court to provide the potential for illuminating selected corners and edges for play of a dark court game.

Figure 4:
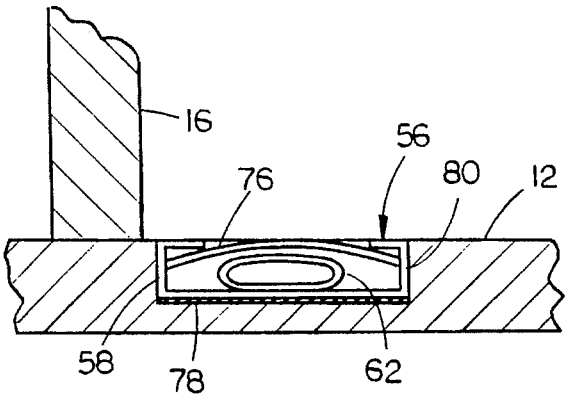
FIG. 4 is a sectional view of an alternate imbedded installation of the illumination markers.

FIG. 4 illustrates an alternate custom installation of the electrically actuated illumination strips 56 in which the channels 58 are inset into the court surface such as floor 12 so that the top edges of the strip are coplanar with the floor surface, thereby to further minimize or eliminate any effect of the illumination strips 56 on the action of a ball which strikes them or a court surface adjacent them. Such grooves 80 may be provided in the upright wall and ceiling 14 in the same manner illustrated for floor 12 in FIG. 4.

The dimensions of the illumination strips are not critical to the invention, but generally the "smaller the better" will govern, except for the width which should be wide enough for clear visibility in the dark. A preferred width for the illumination strips is between about ¼" and 1". The height will largely be determined by the thickness of the neon tube 62 or other illumination source that is used within the strip. Minimizing the height dimension is a definite advantage for minimizing interference with the rebounding of game balls during play.

Each straight segment of the elongated electrically actuated illumination strips 56 may be separately electrically actuated or various combinations of straight segments of the illumination strips may be electrically interconnected for actuation in unison. The precise manner of electrically connecting the various neon tubes 62 to one another and to the switch means for operating them is well known to those skilled in the art of strip lighting. It is preferred that selected illumination markers 30 or strips 56 are electrically connected to respective electrical circuits so that the illumination markers connected to each circuit are illuminated upon actuation of that circuit. As a result, varying combinations of said circuits are actuateable to vary the difficulty of game play in the court 10 in the dark.

Figure 7:
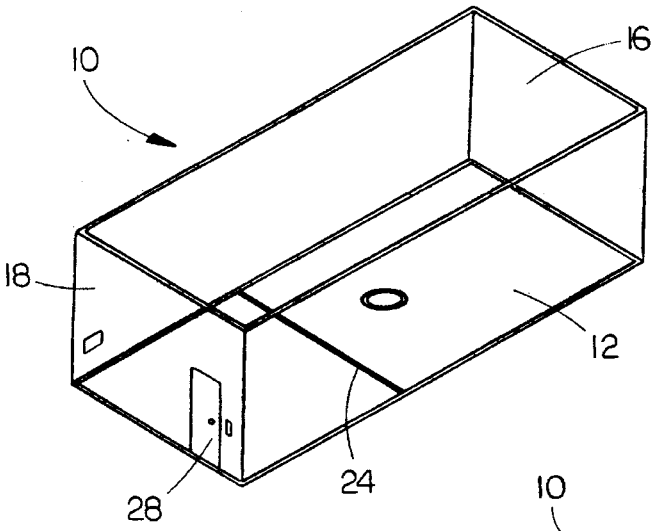
FIG. 7 is a diagrammatic perspective view of a game court with heavy lines indicating an optional selection of illumination markers for a "level 2" difficulty of play.
Figure 8:
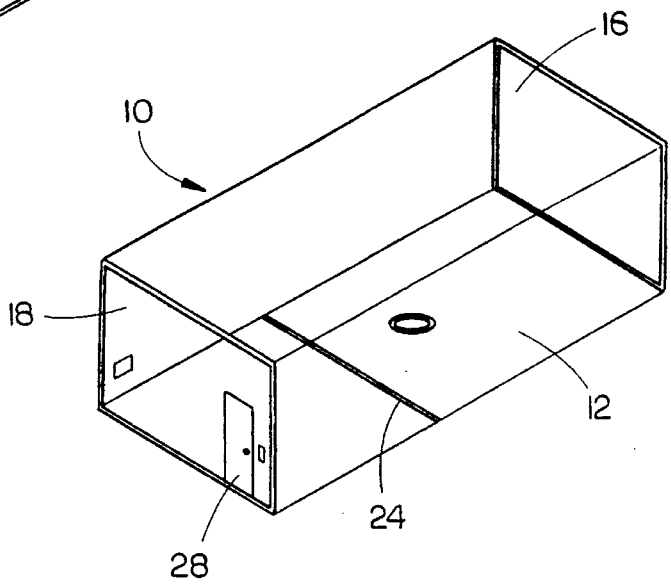
FIG. 8 is a diagrammatic sectional view of a game court with heavy lines indicating a selection of illumination markers constituting a "level 3" difficulty of play.
Figure 10:
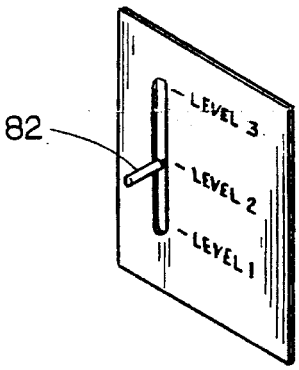
FIG. 10 is a front view of a multi-position switch for selecting a desired level of difficulty for a dark court game.

For example, all of the illumination strips illustrated in FIG. 1 may be electrically connected to a circuit for simultaneous actuation upon movement of multi-position electrical switch 82 (FIGS. 1 and 10) to a position designating "Level 1" for the least difficulty of play). Likewise, FIG. 7 illustrates another combination of illumination strips wherein all are simultaneously illuminated in a single circuit, but for the four vertical corners. The circuit for illuminating this combination of illumination markers 30 or strips 56 may be connected to a middle position on multi-position switch 82 for designating a "Level 2" difficulty of play. Similarly, FIG. 8 designates a still further circuit including all illumination markers 30 or strips 56 but for the horizontal upper and lower edges of the two side walls 20 and 22. This circuit may be electrically connected to switch 82 at an uppermost position for designating a "Level 3" difficulty of play. In the above examples, it is contemplated that the illumination markers designating foul line 24 and service area 26 would be illuminated for all of the three levels of play. These three examples of FIGS. 1, 7 and 8 are illustrated simply to show three possible combinations of illumination strips for play of a dark court game. Many other combinations may be preferred by selected groups of players and can be easily electrically interconnected in a circuit for actuation in unison by some type of switch means. A single multi-position switch 82 shown in FIGS. 1 and 10 is simply one possible switch means for simply and effectively actuating the selected circuit for a game. Any other type of electrical switch means that may be preferred for a given installation could alternately be used. An electrical circuit diagram 4 each of these circuits is not illustrated since such a diagram will be readily apparent to one skilled in the art of electric light circuits and strip lighting generally.

Figure 5:
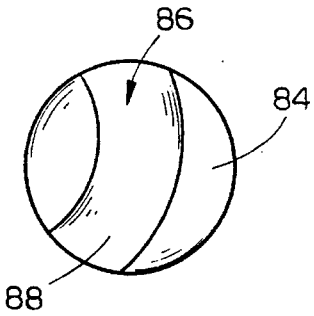
FIG. 5 is a perspective view of a game ball of the invention.
Figure 6:
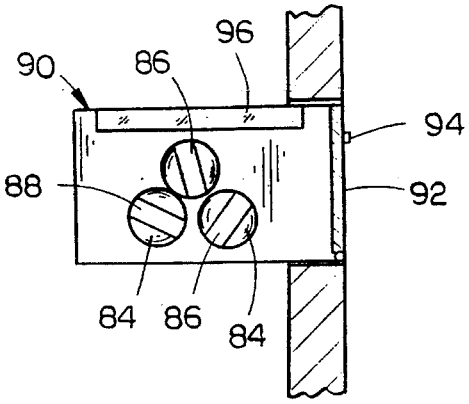
FIG. 6 is a diagrammatic side sectional view through a ball recharging light box of the invention.

FIG. 5 illustrates a game ball 84 for a dark court game. Game ball 84 has an illumination means 86 such as a phosphorescent material 88 on the surface of the ball 84. Preferably, the illumination means 86 covers less than the entire surface of the game ball 84 so that a substantial portion of the game ball surface is not illuminated. This feature is helpful for detecting the direction of spin of a game ball during play. That spin may be critical for determining whether certain "kill shots" for example, effectively struck the front wall 16 before contacting the floor 12. Generally a ball striking the wall first and then the floor will have a reverse rotation wherein the top of the ball rotates rearwardly, whereas a ball which strikes the floor 12 before the front wall 16 will tend to have a forward rotation wherein the bottom of the ball rotates rearwardly. The players are thus afforded a way to judge the accuracy of their shots in the dark.

In the case of a game ball 84 having phosphorescent material 88 as the illumination means 86, it will be necessary to charge that material with light so that it illuminates when taken into the dark. This recharging step may be accomplished by providing a light box 90 built into a court wall such as side wall 20 with a hinged door 92 having an outer surface coplanar with wall 20 to eliminate interference with a ball striking the box 90. Some type of minimal handle 94 may be provided for opening and closing door 92. Within the box 90 a source of illumination such as a fluorescent tube 96, in candescent bulb or the like maintains a high level of light intensity within the box for recharging the phosphorescent material on the balls 84 in a minimal amount of time.

Figure 9:
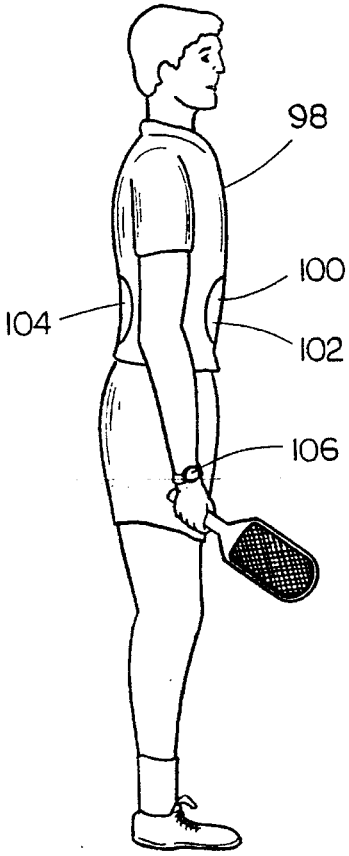
FIG. 9 is a side view of a game court player wearing illumination markers.

Finally, FIG. 9 illustrates a game player 98 wearing several illumination markers so that his position within a dark court can be detected by his opponent for strategy reasons and to avoid collisions. Such markers may include a front marker 102 on the abdomen, a back marker 104 on the player's back and perhaps a wrist marker 106 on each wrist. These are mentioned for illustration purposes only as it is apparent that many locations for such illumination markers on a player could be substituted. These markers could be of a phosphorescent material sewn or otherwise applied onto athletic clothing or they may be provided as removable stickers readily placed on or removed from one's clothing or skin surface.

The invention is furthermore directed to a method of preparing a game court 10 for play in the dark, including the steps of providing a plurality of illumination markers 30, securing the illumination markers 30 to the court 10 to identify locations thereon in the dark, substantially excluding external light from the court 10 to render the court dark, illuminating at least some of the illumination markers 30, providing a game ball 84 having means 86 for illuminating at least a portion of the surface thereof and illuminating that portion of the game ball 84.

The method furthermore contemplates varying the difficulty of game play by illuminating more or less of the illumination markers 30. Other steps of the method of the invention are evident from the above description of the dark court game apparatus of the invention.

Whereas the invention has been shown and described in connection with certain preferred embodiments thereof, it is understood that many modifications, alterations and substitutions may be made within the intended broad scope of the appended claims. For example the elongated electrically actuated illumination strips 56 may be single or interconnected series of neon tubes 62 or they may be a whole line of separate illumination means such as light emitting diodes. Likewise, whereas game balls are shown with rechargeable illumination means 86, any other known type of illumination means that can be applied to a game ball may be substituted. The light filter 76 may simply be a strip of translucent colored plastic of the type used by lighting professionals for filtering light. The color may be varied to suit particular tastes. Any other known means for filtering the light source from the strips to reduce the radiation of light into the court may be substituted as desired. These are but a few of the broad range of known elements which may be incorporated into the overall dark court game apparatus as described above.

I claim:

1. A method for preparing a game court for play in the dark, said court having a floor, ceiling and side walls defining an enclosure, said method comprising, providing a plurality of illumination markers to said court to identify locations thereon in the dark, illuminating at least some of said illumination markers, providing a game ball having means for illuminating at least a portion of the surface thereof, illuminating at least a portion of the surface of the game ball, and substantially eliminating light from said court other than from said illumination markers and said game ball, thereby to render the court dark.

2. The method of claim 1 further comprising varying the difficulty of game play by illuminating more and less of said illumination markers.

3. The method of claim 2 wherein said illumination markers comprise elongated electrically actuated illumination strips.

4. The method of claim 3 wherein said electrically actuated illumination strips comprise neon light tubes.

5. The method of claim 3 further comprising substantially enclosing said elongated electrically actuated illumination strips within a channel and covering said channel with a light filter to reduce radiation of light into the court from said strips.

6. The method of claim 5 wherein covering said channel comprises arranging a colored translucent sheet over said channel.

7. The method of claim 1 comprising arranging said illumination markers adjacent the edges of said floor, ceiling and walls.

8. The method of claim 7 further comprising arranging said illumination markers to define a service area and foul line on said floor.

9. A method of claim 3 further comprising:

partially illuminating a game player to identify his position and prevent collisions.

10. The method of claim 9 wherein partially illuminating a game player comprises securing light emitting markers onto said game player.

11. An apparatus for playing a ball based court game in the dark, comprising, a substantially enclosed court having a floor, ceiling and side walls operative to substantially exclude exterior light from said court, a plurality of illumination markers secured to the court to identify locations thereon in the dark, a game ball, and illuminating means on said game ball for illuminating at least a portion of the surface thereof in the dark whereby said illumination markers and said game ball illuminating means enable play of a ball based court game in the dark.

12. The apparatus of claim 11 wherein said illumination markers comprise elongated electrically actuated illumination strips.

13. The apparatus of claim 12 wherein electrically actuated illumination strips comprise neon light tubes.

14. The apparatus of claim 12 further comprising at least one elongated shallow channel having an open side, said elongated electrically actuated illumination strips being situated within said channel to reduce radiation of light therefrom into said court.

15. The apparatus of claim 14 further comprising a light filter covering said channel to further restrict radiation of light into the court from said elongated electrically actuated illumination strips.

16. The apparatus of claim 15 wherein said light filter comprises a colored translucent sheet.

17. The apparatus of claim 12 further comprising a plurality of electrical circuits, selected illumination markers being electrically connected to respective electrical circuits, and switch means for electrically actuating each electrical circuit such that the illumination markers connected to the circuit are illuminated upon actuation of that circuit, whereby varying combinations of said circuits are actuateable to vary the difficulty of game play on said court in the dark.

18. The apparatus of claim 17 wherein said switch means comprises a single multi-position switch.

19. The apparatus of claim 11 wherein said illumination markers are secured to said court adjacent the edges of said floor, ceiling and walls.

20. The apparatus of claim 19 wherein said illumination markers are secured to said court at positions to define a service area and foul line on said floor.

21. The apparatus of claim 11 wherein said game ball illuminating means comprises phosphorescent material on the surface of said ball.

22. The apparatus of claim 21 wherein said phosphorescent material covers less than the entire surface of said game ball such that a substantial portion of the game ball surfaces not illuminated.

23. The apparatus of claim 11 further comprising a plurality of light illuminating markers, and means for securing a light illuminating marker on a game player to identify his position in the dark and prevent collisions in the court.

* * * * *